US007156152B2

(12) United States Patent
Hohenbichler

(10) Patent No.: US 7,156,152 B2
(45) Date of Patent: Jan. 2, 2007

(54) PROCESS FOR THE CONTINUOUS PRODUCTION OF A THINK STEEL STRIP

(75) Inventor: Gerald Hohenbichler, Kronstorf (AT)

(73) Assignee: Voest-Alpine Industrieanlagenbau GmbH & Co. (AT)

( * ) Notice: Subject to any disclaimer, the term of this patent is extended or adjusted under 35 U.S.C. 154(b) by 34 days.

(21) Appl. No.: 11/107,948

(22) Filed: Apr. 15, 2005

(65) Prior Publication Data

US 2005/0205233 A1 Sep. 22, 2005

Related U.S. Application Data

(63) Continuation-in-part of application No. PCT/EP2003/011007, filed on Oct. 6, 2003.

(51) Int. Cl.
*B22D 11/06* (2006.01)

(52) U.S. Cl. ..... 164/480; 164/444

(58) Field of Classification Search ..... 164/480, 164/448, 444
See application file for complete search history.

(56) References Cited

U.S. PATENT DOCUMENTS

| | | | |
|---|---|---|---|
| 4,702,300 A | 10/1987 | Nakanori et al. | |
| 5,368,088 A | 11/1994 | Furuya et al. | |
| 5,706,882 A | 1/1998 | Fellus et al. | |
| 5,720,336 A * | 2/1998 | Strezov | 164/480 |
| 5,927,375 A | 7/1999 | Damasse et al. | |

FOREIGN PATENT DOCUMENTS

| | | |
|---|---|---|
| EP | 0320572 | 6/1989 |
| EP | 0411962 | 2/1991 |
| EP | 0800881 | 10/1997 |
| JP | 09262643 | 10/1997 |
| JP | 11179493 | 7/1999 |
| WO | WO 95 13889 | 5/1995 |
| WO | WO 00 07753 | 2/2000 |

* cited by examiner

*Primary Examiner*—Len Tran
(74) *Attorney, Agent, or Firm*—Ostrolenk, Faber, Gerb & Soffen, LLP

(57) ABSTRACT

A process for the continuous production of a thin steel strip, in which a steel melt from a melt reservoir is introduced onto one or more, in particular two, cooled shaping wall surfaces which move synchronously with a casting strip, in particular rotate in the form of casting rolls and at least partially solidifies at the shaping wall surface to form the casting strip. The steel melt, in terms of the crucial alloying constituents, contains less than 1% by weight of Ni and less than 1% by weight of Cr and less than 0.8% by weight, in particular less than 0.4% by weight, of C and at least 0.55% by weight of Mn. In the process, recesses are arranged on the shaping wall surface in a random pattern, distributed uniformly over the shaping wall surface, and the roll separating force (RSF) at the shaping wall surface is set to a value of between 5 and 150 N/mm, in particular between 5 and 100 N/mm.

20 Claims, 2 Drawing Sheets

PROCESS FOR THE CONTINUOUS PRODUCTION OF A THINK STEEL STRIP

CROSS REFERENCE TO RELATED APPLICATION

The present application is a continuation in part under 35 U.S.C. § 120 of a PCT/EP2003/011007 filed 6 Oct. 2003, which claims priority of Austrian Application No. A1561/2002 filed 15 Oct. 2002. The PCT International Application was published in the German language.

BACKGROUND OF THE INVENTION

The invention relates to a process and to an installation for the continuous production of a thin steel strip. The installation has at least two casting rolls and if appropriate, has laterally arranged side plates. It is possible for a casting reservoir, from which liquid steel melt can be introduced to the casting rolls, to form between the casting rolls and the side plates during operation.

- less than 1% by weight of Ni
- less than 1% by weight of Cr
- less than 0.8% by weight of C, in particular less than 0.4% by weight of C
- at least 0.55% by weight of Mn the casting strip produced, in particular when the two-roll casting process which is known from the prior art is used, has many cracks and surface defects, which significantly reduce the quality of the steel strip produced.

SUMMARY OF THE INVENTION

It is an object of the present invention to avoid these known drawbacks of the prior art and to further develop a process and an installation for the steel grades in accordance with the preamble of the independent claims, in such a manner that it is possible to produce a corresponding steel strip more economically.

According to the invention, this object is achieved by a process and installation having the features of the independent claims.

According to a particular embodiment of the invention, the casting rolls referred to are the casting rolls used in a two-roll casting process. In addition, however, the term casting roll by definition also encompasses all other shaping wall surfaces which are known from the prior art. According to the prior art, the surface of a casting roll is preferably produced by a process engineering technique which involves material-removing machining, in particular by turning and/or grinding. During the production of strips using the casting rolls which are known from the prior art, in particular in accordance with the two-roll casting process, and with RSF values of between 100 N/mm and 250 N/mm (roll separating force) which are customary in the prior art, the strips produced, in addition to significant evidence of cracking, also show evidence of very considerable temperature differences across the strip width and along the strip length, from which considerable fluctuations in forces and uneven solidification characteristics can be inferred.

During the direct casting of non-stainless (Cr and/or Ni content in each case below 1%) liquid steel to form thin strips with a thickness of between 1 and 10 mm, use of the process parameters which are known from the prior art therefore produces a steel strip of inadequate quality. In this context, microcracks which are frequently formed on the strip are particularly critical.

The procedure described in the present invention has for the first time made it possible, with the abovementioned composition of the steel melt, to produce a crack-free strip with a good strip profile, in particular a good strip crown. Furthermore, it is possible to achieve a strip temperature across the width of the strip which is more homogeneous than in the prior art even just below the permanent mold or casting rolls, in particular within a strip width, of ±25 K. The strip produced using the process according to the invention does not generally have any thermally induced diagonal streaks and is distinguished by a good quality of its edges.

According to a particular embodiment of the invention, there are two casting rolls for operating a two-roll casting process, in which case recesses which are distributed in a random pattern uniformly over the casting roll surface are arranged on the surfaces of both casting rolls.

According to a particular embodiment of the present invention, the surface structure of the casting roll used is characterized by substantially uniformly distributed recesses. According to one particular embodiment, these recesses are indentations and/or protuberances, produced mechanically, for example, in the surface of the casting roll, with a height distance of 3 to 80 micrometers, in particular from 20 to 40 micrometers, being set between the rim, in particular the burr, and the deepest point of a recess.

According to one embodiment of the process according to the invention, between 1 and 20 recesses per $mm^2$ of the casting roll surface area are arranged on the casting roll surface in a random pattern, distributed uniformly over the casting roll surface.

As tests have shown, this inventive measure makes it possible to produce a particularly high-quality surface of the steel strip.

According to one embodiment of the process according to the invention, the Si content of the steel melt is set to less than 0.35% by weight of Si.

As tests have shown, this inventive measure makes it possible to produce a steel strip with particularly high-quality mechanical properties, in particular with an improved toughness.

According to one embodiment of the process according to the invention, the at least partially solidified casting strip is taken off the casting rolls at a rate of more than 30 m/min.

In practice, it has been found that this inventive measure makes it possible to realize a particularly high-quality surface, combined at the same time with improved process economics. At lower rates, overflows and the formation of creases in the strip surface (often associated with surface cracks) are observed with increasing regularity.

According to one embodiment of the process according to the invention, the roughness average of the surface of at least one of the casting rolls is set to more than 3 μm, with the stochastic distribution of the recesses being effected by a mechanical treatment of the casting roll surface, in particular by shot peening.

According to one embodiment of the process according to the invention, the mechanical treatment of the casting roll surface is carried out by shot peening using shot with a target diameter D in the range from 0.5 mm to 2.2 mm, with from 1 to 250 individual pieces of shot per $mm^2$ of surface area striking the region of the surface which is subjected to the shot peening during this operation.

According to one embodiment of the process according to the invention, the pieces of shot used for shot peening deviate from the abovementioned target diameter D at most by a maximum standard deviation of 30%.

According to one embodiment of the process according to the invention, the liquid steel meniscus (=casting level) is oriented at an angle of between 30° and 50° from the geometric kissing point, i.e. the radii running from the casting roll axis on the one hand horizontally towards the geometric kissing point and on the other hand towards the meniscus include a steel bath contact angle of 30°–50°.

According to one embodiment of the process according to the invention, the melt reservoir is laterally delimited by the two casting rolls and by suitable side plates and is at least partially covered at the top by a suitable covering, so that it is substantially protected from the ingress of media which do not form part of the process, in particular dust-containing air and/or oxidizing gases.

According to one embodiment of the process according to the invention, the melt reservoir is exposed to a substantially inert atmosphere, the inert gas supplied being formed by 0–100% by volume of $N_2$, remainder argon or another ideal gas or $CO_2$.

According to a particular embodiment of the process according to the invention, the inert gas supplied contains up to 7% of $H_2$.

According to a particular embodiment, the space between the melt reservoir and the upper cover is at least partially filled or purged by a gas which is substantially inert with respect to the steel melt.

According to one embodiment of the process according to the invention, the inert atmosphere applied to the melt reservoir, in terms of its oxygen content, is limited to a maximum $O_2$ content of 0.05% by volume.

According to one embodiment of the process according to the invention, the crown of the casting strip and the edge drop are determined at a measuring section at the exit from the casting rolls.

The strip crown and the edge drop are defined in accordance with DIN standards.

According to one embodiment of the process according to the invention, the casting rolls are subjected to preliminary cold-profiling in such a manner that a strip crown of between 20 μm and 150 μm and an edge drop in the strip thickness between the edge of the strip and a distance of 40 mm from the edge of the strip of less than 150 μm are set for the steel strip as it leaves the permanent mould.

According to one embodiment of the process according to the invention, during casting the hot profile of the casting rolls is set by one or more suitable actuators at the casting rolls, as a function of one or more of the following casting parameters:

gas composition
strip thickness
solidification heat produced
casting rate
meniscus angle in such a manner that a strip crown of between 20 μm and 150 μm and an edge drop in the strip thickness between the edge of the strip and a distance of 40 mm from the edge of the strip of less than 150 μm are achieved in the steel strip as it leaves the permanent mould.

Tests have shown that this inventive measure, continuing to take account of the roll separating force RSF, makes it possible to achieve a degree of solidification which is sufficiently uniform over the width of the casting strip, in particular including in the region of the strip edges, and thereby to further increase the efficiency of the proposed process according to the invention.

According to one embodiment of the process according to the invention, a strip crown of between 30 μm and 90 μm and an edge drop of less than 100 μm are set in the casting strip.

According to one embodiment of the process according to the invention, the roughness of the casting roll surface of at least one of the casting rolls is set to be very smooth, in particular with an arithmetic roughness average of at most 2 μm, in an edge region of the casting roll of 3–30 mm.

According to one embodiment of the process according to the invention, the roll separating force is regulated and/or controlled with an accuracy of at least ±15 N/mm with respect to a roll separating force target value.

A preferred application of the process is for steel grades in which the steel melt has the following composition:

less than 1% by weight of Ni
less than 1% by weight of Cr
less than 0.8% by weight of C, in particular less than 0.4% by weight of C
at least 0.55% by weight of Mn
remainder Fe and production-related impurities.

The invention is also characterized by an installation in accordance with the invention.

According to one embodiment of the installation according to the invention, from 1 to 20 recesses are provided per $mm^2$ of casting roll surface area.

According to one embodiment of the installation according to the invention, a surface structure which is produced by shot peening, in particular a surface structure which is blasted with shot with a diameter of between 0.5 mm and 2.2 mm and a shot diameter scatter of less than 30% (based on a target diameter D situated within the said diameter range), preferably using 1 to 250 pieces of shot per $mm^2$, is provided as the casting roll surface.

According to one embodiment of the installation according to the invention, a cover, which can be used to cover the melt reservoir, is provided above the two casting rolls.

According to one embodiment of the installation according to the invention, there is a suitable device, by means of which a gas atmosphere which has a substantially inert behavior with respect to the steel melt, can be set in the region of the melt reservoir, above the steel melt, in particular in the space between the steel melt and the cover.

According to one embodiment of the installation according to the invention, there is a measuring section for determining the crown of the casting strip and/or the edge drop of the strip thickness between the edge of the strip and a distance of 40 mm from the edge of the strip.

According to one embodiment of the installation according to the invention, at least one of the casting rolls is subjected to preliminary cold-profiling.

According to one embodiment of the installation according to the invention, at least one actuator, which can be used to set the hot profile of the casting roll according to one or more of the following casting parameters gas composition
strip thickness
solidification heat produced
casting rate
meniscus angle is provided at at least one of the casting rolls.

According to one embodiment of the installation according to the invention, there is a regulating device which can be used to set the hot profile and/or cold profile of at least one of the casting rolls as a function of the measured strip crown and the measured edge drop in the strip thickness between the edge of the strip and a distance of 40 mm from the edge of the strip.

According to one embodiment of the installation according to the invention, at least one of the casting rolls has a roughness average of at most 2 μm in an edge region of 3 to 30 mm.

According to one embodiment of the installation according to the invention, there is a device for regulating the roll separating force with an accuracy of at least ±15 N/mm.

According to one embodiment of the installation according to the invention, the casting rolls are arranged such that they can be moved towards one another. According to a further embodiment of the installation according to the invention, there is on the one hand a device for measuring the force with which the casting rolls can be moved towards one another and on the other hand a device for controlling the movement of the casting rolls towards one another as a function of the measured forces.

According to one embodiment of the installation according to the invention, there is a suitable device which can be used to change the camber of at least one of the casting rolls while the installation is operating.

According to a further particular embodiment of the installation according to the invention, there is a suitable device which can be used to change the hot shape of the edge region of at least one of the casting rolls while the installation is operating.

According to one embodiment of the installation according to the invention, there is a suitable device for measuring the meniscus angle and if appropriate a suitable device for regulating and/or controlling the meniscus angle.

According to one embodiment of the installation according to the invention, there is a device for measuring the strip profile.

According to one embodiment of the installation according to the invention, at least one of the casting rolls substantially comprises a material of good thermal conductivity, in particular copper or a copper alloy. According to a particular embodiment of the installation according to the invention, at least one of the installations has a cooling device arranged in the interior.

According to one embodiment of the installation according to the invention, at least one of the casting rolls has a chromium coating with a minimum layer thickness of 10 μm on the outer side. According to a further particular embodiment, an intermediate layer which is at least 0.5 mm thick, in particular an intermediate layer made from nickel and/or an Ni alloy, is provided beneath the chromium coating.

According to a particular embodiment of the installation according to the invention, there is a device for measuring the speed of at least one casting roll and transmitting a desired speed value to the casting roll drives, in order to set the desired speed which has been determined, via a closed-loop control circuit which takes account of some of the other significant casting parameters, such as for example the current roll separating force and/or the current meniscus angle.

According to a particular embodiment of the installation according to the invention, there is a device for throttling and regulating the supply of liquid steel, so that the desired meniscus angle can be set, or can be regulated by means of a suitable closed-loop control circuit, which at least takes into account the actual value of meniscus angle.

In the case of direct casting of non-stainless (Cr and/or Ni content in each case below 1%) liquid steel, with a C content of less than 0.45% C, in particular less than 0.1% C, into thin strips with a thickness of between 1 and 10 mm using the two-roll casting process, it was not possible, given the surface topologies and cold profiles of the casting rolls known from the prior art and the standard inserting gas mixture (in the permanent mold) which is customary from the prior art, and given roll separating forces selected in accordance with the known AISI 304 grade, to achieve either a strip without microcracking or a stable, continuous, uninterrupted casting process with a temperature homogeneity across the width of better than ±30 K (measured approx. 1–2 m below the geometric kissing point). With casting rates above 30 m/min, in particular above 50 m/min, on the one hand dark, inclined transverse streaks were observed at the temperature profile measuring point beneath the permanent mold, and on the other hand considerable strip edge bleeding and the occurrence of dovetailed edges were found.

According to a particular embodiment of the present invention, a stainless steel with a C content of up to 0.5% is cast at casting rates of over 30 m/min, in particular of over 50 m/min, using one or more of the following parameters:

- stable casting roll surface topology achieved by shot peening using steel shot of a defined diameter with an accuracy d±30%, where d is between 0.5 and 2.2 mm. During the shot-peening process, from 1 to 250 pieces of shot should strike one $mm^2$ of casting roll surface area
- the liquid crater between the two casting rolls is covered at the top by a permanent-mold cover, with a gas of the following composition being used to inert the atmosphere above the casting level: 0–100% of $N_2$; remainder Ar or another ideal gas or $CO_2$; up to 7% of $H_2$ and minimal impurities, as are almost inevitable in technical-grade gases, are allowed (at any rate less than 0.05% of $O_2$)
- casting or roll separating forces of between 5 and 100 kN per meter of strip width
- strip crown (defined in accordance with hot strip DIN standard) between 20 and 120 μm, preferably between 30 and 90 μm.

According to further preferred embodiments, the cast steel has the following composition:

C content less than 0.1% and/or Mn content between 0.5 and 1.5% and/or Si content between 0.01 and 0.35%.

According to a further preferred embodiment, the casting rolls used have a roughness average of Ra>3 μm, preferably of Ra>6 μm.

According to a further preferred embodiment of the invention, at least one of the casting rolls used has a chromium coating with a layer thickness of at least 10 μm and/or a nickel coating, if appropriate located beneath the chromium coating, with a layer thickness of at least 0.5 mm. According to a further preferred embodiment, the lateral surface of the casting roll is made from copper, which if necessary can be used as a base for all kinds of roll coatings.

According to one embodiment of the process according to the invention, the casting roll does not have any significant roughness (Ra ≦2.0 μm) in an edge region of 3–30 mm.

According to one particular embodiment of the invention, during the continuous production of strip in a two-roll casting device, liquid steel is introduced between two horizontally arranged casting rolls which rotate in opposite directions and have a suitable cooling device, in particular arranged in the rolls, especially water cooling. The liquid metal rapidly forms a solidified shell on contact with the cooled casting rolls, the solidified shells being at least partially pressed together under low roll separating forces at the location of the geometric "kissing point" between the casting surfaces (location of the shortest distance between the casting surfaces). The solidified strand or solidified strip is taken off beneath the kissing point.

According to various embodiments of the invention, the liquid metal can be cast out of a ladle into a smaller vessel, from which it is cast, via a suitable casting nozzle, into the strip-casting installation or into the space above the kissing point between the two casting rolls. According to a particular embodiment of the invention, the metal which has been introduced forms a melt reservoir above the kissing point, which is delimited on the one hand by the surfaces of the casting roll and on the other hand by suitable side plates or other suitable devices, for example suitable electromagnetic devices. According to a preferred embodiment, the side plates are designed to be moveable.

BRIEF DESCRIPTION OF THE DRAWINGS

The invention is explained in non-limiting fashion below, in accordance with a particular embodiment, with reference to diagrammatic drawings, in which.

Figure 1:
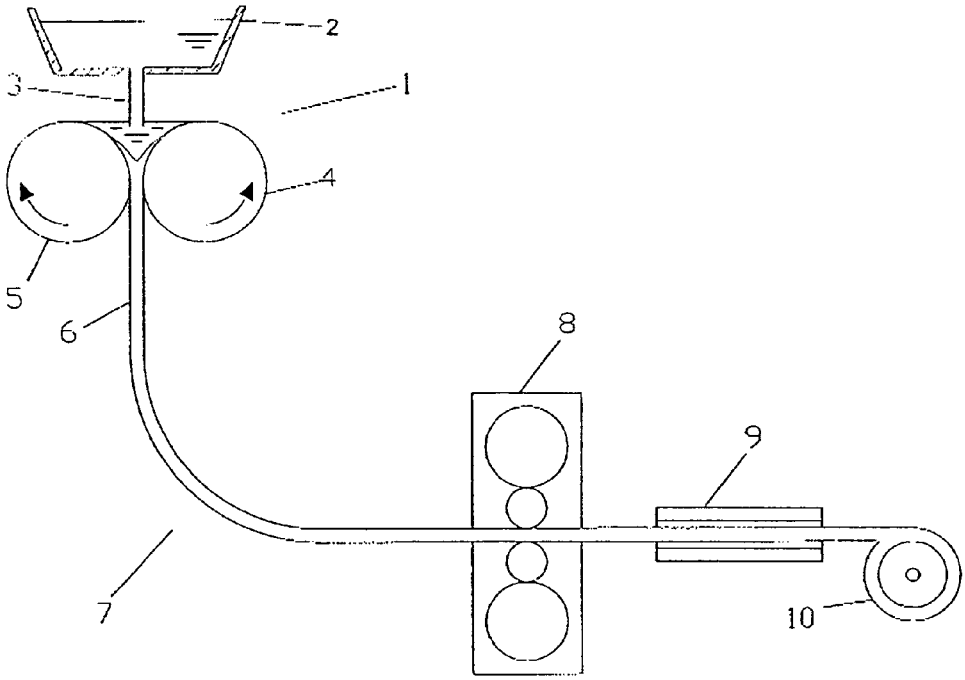
FIG. 1 shows an apparatus and a process for producing a thin steel strip in accordance with the invention.

The casting and rolling apparatus illustrated in FIG. 1 has a strip-casting installation 1 comprising a casting ladle 2 with a casting nozzle 3 and two oppositely rotating casting rolls 4, 5. The casting strip 6 is conveyed via a cooling section 7 to a rolling stand 8. In the rolling stand 8, the thickness of the metal strip is reduced by at least 10%. The strip which has been rolled in this way is conveyed through a holding and/or heating device 9 and is coiled at a coiler 10. According to a particular embodiment of the invention, the coiled strip is heat-treated in a suitable heat-treatment installation (not shown).

Figure 2:
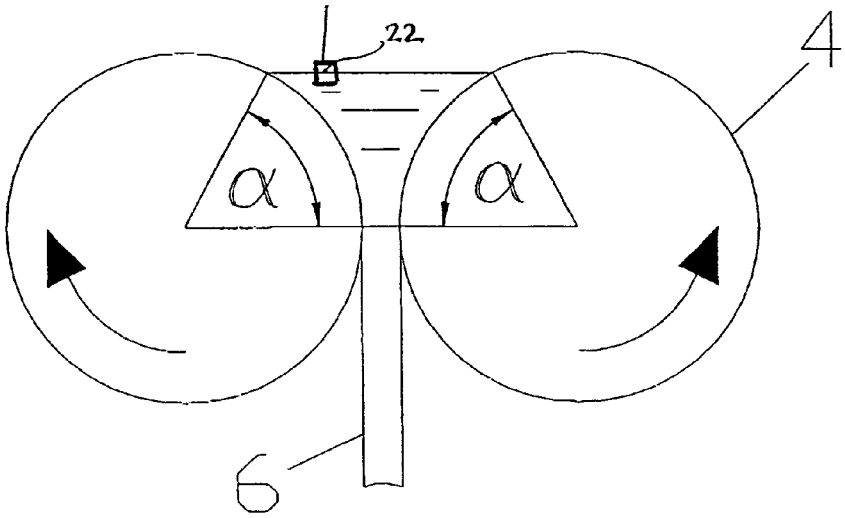
FIG. 2 shows a detail of an apparatus and a process for producing a thin steel strip in accordance with the invention.

The definition of the meniscus angle $\alpha$ can be seen from FIG. 2. The meniscus angle $\alpha$ is determined on the basis of a normal section (plane perpendicular to the centre axis of the casting roll) between the connection of the point of contact of the casting level with the outer circumference of the casting roll and the centre point of the casting roll and the connection between the centre point of the casting roll and the centre point of the further casting roll.

According to a particular embodiment of the invention, the meniscus angle is measured, for example, by determining the height of the casting level.

Figure 3:
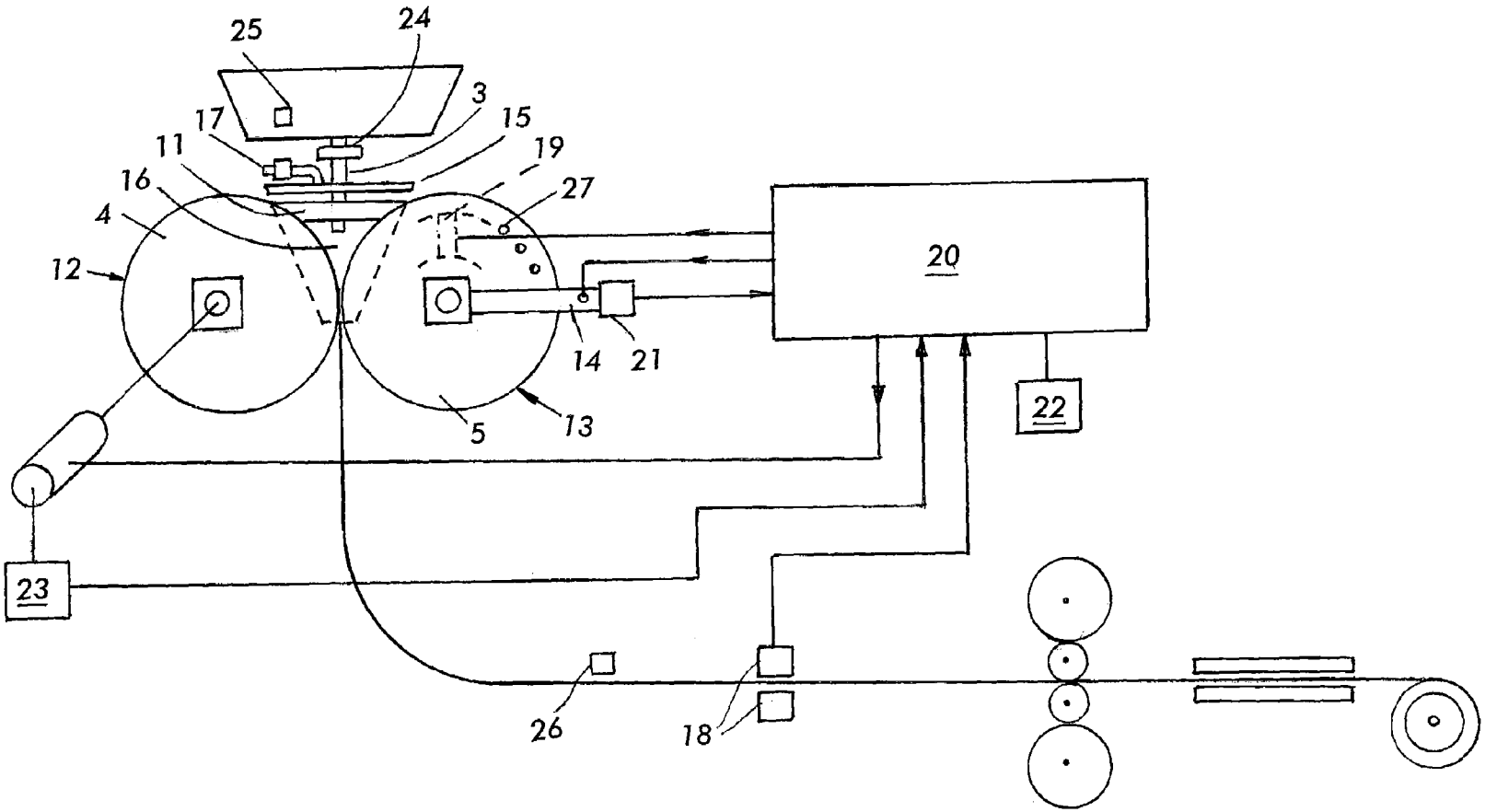
FIG. 3 is a view like FIG. 1, showing further features of the apparatus and process.

One of the two laterally arranged side plate 11 is shown in FIG. 3. The two side plates and the casting roll surfaces 12, 13 of the two casting rolls together define a casting reservoir 16.

The casting reservoir is covered by a cover 15 between the two casting rolls and the two side plates. A device 17 for setting a gas atmosphere within the casting reservoir is assigned to the cover. Such a device is also described in U.S. Pat. No. 6,415,849 incorporated herein.

A device 14 for regulating the roll separating force is shown connected with the casting roll 5. It allows positioning of one casting roll 5 at a selected distance from the casting roll 4 and regulates the roll separating force during casting.

In an area downstream of the casting unit and upstream of the rolling mill a measuring section 18 is positioned. It allows determining the crow of the casting strip and the edge drop of the strip thickness. Further on, measuring section 18 allows determining the casting strip thickness and the profile of the casting strip over the strip width.

At least one actuator 19 is provided at at least one of the casting rolls. One possible solution (actuator) to set the hot profile of the casting roll is described in U.S. Patent Publication 2002/0112841 A1 incorporated herein. A supporting disk is hydraulically adjustable in the longitudinal direction of the casting roll. See above U.S. publication application. The actuator is controlled by casting parameters selected from the group consisting of: gas composition, strip thickness, solidification heat produced, casting rate and meniscus angle. The gas composition is detected by the device 17 for setting a gas atmosphere. The strip thickness is detected by the measuring section 18.

The solidification heat produced is detected by temperature measuring devices 25, 26 positioned, e.g., in the casting ladle 2, for measuring the temperature of a molten metal and near the casting strip surface for measuring the strip surface temperature. Based on these measurements, the solidification heat could be calculated.

The casting rate is detected by a device 23 for measuring the speed of the casting roll.

The meniscus angle is detected by a device 22 for measuring and calculating the meniscus angle.

The device 22 for measuring and regulating and controlling the meniscus angle is, e.g. a float lever, and is shown in FIG. 2.

A regulating device 20 comprised of a computer unit controls the entire production process. Setting of the hot profile of at least one casting roll is one function of this regulating device.

The device 20 is operable for regulating the movement of the casting roll.

A device 27 is operable to change the camber of at least one of the casting rolls. In the FIG. 3 embodiment, the internal roll cooling of the casting roll is a practicable system to adjust the camber of the casting roll, for example based on profile measuring device 18.

A device 24 for throttling and regulating the supply of liquid steel is shown in FIG. 3 as a sliding gate.

The invention claimed is:

1. A process for continuous production of a thin steel strip, comprising:

introducing a steel melt from a melt reservoir between two rotating and cooled casting rolls, which move synchronously with a casting strip, such that the steel melt at least partially solidifies at the casting rolls to form the casting strip, wherein the steel melt includes at least alloying constituents of:

less than 1% by weight of Ni less than 1% by weight of Cr less than 0.8% by weight of C, in particular less than 0.4% by weight of C at least 0.55% by weight of Mn wherein recesses are arranged on a peripheral surface of at least one of the casting rolls, the recesses being in a random pattern distributed uniformly over the casting roll surface, and wherein a roll separating force at the casting rolls is regulated to a value of between 5 and 150 N/mm.

2. The process according to claim 1, wherein between 1 and 20 recesses per $mm^2$ of casting roll surface area are arranged on the casting roll surface in a random pattern, distributed uniformly over the casting roll surface.

3. The process according to claim 1, wherein the steel melt has an Si content of less than 0.35% by weight of Si.

4. The process according to claim 1, further comprising removing the at least partially solidified casting strip from the casting rolls at a rate of more than 30 m/min.

5. The process according to claim 1, wherein the roughness average of the surface of at least one of the casting rolls is set to more than 3 μm, and the recesses are arranged with a stochastic distribution wherein the recesses are formed by a mechanical treatment of the casting roll surface.

6. The process according to claim 5, wherein the mechanical treatment of the casting roll surface comprises shot peening using shot with a target diameter D in the range from 0.5 mm to 2.2 mm, with from 1 to 250 individual pieces of shot per $mm^2$ of surface area directed to strike a region of the casting roll surface which is subjected to the shot peening.

7. The process according to claim 6, wherein the shot used for the shot peening deviate from the target diameter D by a maximum standard deviation of 30%.

8. The process according to claim 1, wherein the steel melt is held between the casing rolls and the melt there includes a meniscus, the rolls have a geometric kissing point at their closest proximity to one another; the meniscus is oriented at a circumferential angle around the rolls of between 30° and 50° from the geometric kissing point of the rolls.

9. The process according to claim 1, wherein the melt reservoir is laterally delimited by the two casting rolls and by side plates extending across the casting rolls and is at least partially covered at the top to substantially protect from ingress of media which do not form part of the process.

10. The process according to claim 1, further comprising, exposing the melt reservoir to a substantially inert atmosphere of an inert gas comprised of 0–100% by volume of $N_2$, remainder argon or another inert gas or $CO_2$ and optionally up to 7% of $H_2$.

11. The process according to claim 10, wherein the inert atmosphere, during a steady-state casting operation has a maximum $O_2$ content of 0.05% by volume.

12. The process according to claim 1, further comprising determining the crown of the casting strip and the edge drop at a measuring section at the exit of the strip from the casting rolls.

13. The process according to claim 1, further comprising subjecting the casting rolls to preliminary cold-profiling such that a strip crown of between 20 mm and 150 mm and an edge drop in the strip thickness between the edge of the strip and a distance of 40 mm from the edge of the strip of less than 150 mm are set for the steel strip as it leaves the permanent mold.

14. The process according to claim 1, further comprising setting the hot profile of the casting rolls during casting by at least one actuators actuator at the casting rolls, as a function of at least one of casting parameters selected from the group consisting of:

gas composition strip thickness solidification heat produced casting rate meniscus angle such that a strip crown of between 20 mm and 150 mm and an edge drop in the strip thickness between the edge of the strip and a distance of 40 mm from the edge of the strip of less than 150 mm are achieved in the steel strip as it leaves the permanent mold.

15. The process according to claim 1, wherein a strip crown of between 30 mm and 90 mm and an edge drop of less than 100 mm are achieved in the casting strip.

16. The process according to claim 1, further comprising setting the roughness of the casting roll surface of at least one of the casting rolls to be very smooth, with an arithmetic roughness average of at most 2 μm, in an edge region of the casting roll of 3–30 mm.

17. The process according to claim 1, wherein the roll separating force is regulated or controlled with an accuracy of at least ±15 N/mm.

18. The process according to claim 1, wherein the steel melt has a composition:

less than 1% by weight of Ni less than 1% by weight of Cr less than 0.8% by weight of C, in particular less than 0.4% by weight of C at least 0.55% by weight of Mn remainder Fe and production-related impurities.

19. The process according to claim 1, wherein the value is between 5 and 100 N/mm.

20. The process according to claim 5, wherein the process is shot peening.

* * * * *

UNITED STATES PATENT AND TRADEMARK OFFICE

CERTIFICATE OF CORRECTION

PATENT NO. : 7,156,152 B2
APPLICATION NO. : 11/107948
DATED : January 2, 2007
INVENTOR(S) : Gerald Hohenbichler It is certified that error appears in the above-identified patent and that said Letters Patent is hereby corrected as shown below:

Title page
(54) Title should be --PROCESS FOR THE CONTINUOUS PRODUCTION OF A THIN STEEL STRIP--

Signed and Sealed this

Twentieth Day of March, 2007

JON W. DUDAS
*Director of the United States Patent and Trademark Office*